US006237362B1

(12) United States Patent
Jang

(10) Patent No.: US 6,237,362 B1
(45) Date of Patent: May 29, 2001

(54) INTERNAL OIL SEPARATOR FOR COMPRESSORS OF REFRIGERATION SYSTEMS

(75) Inventor: Kil Sang Jang, Taejon-si (KR)

(73) Assignee: Halla Climate Control Corp. (KR)

( * ) Notice: Subject to any disclaimer, the term of this patent is extended or adjusted under 35 U.S.C. 154(b) by 0 days.

(21) Appl. No.: 09/548,419

(22) Filed: Apr. 13, 2000

(30) Foreign Application Priority Data

Dec. 30, 1999 (KR) ..... 99-66672
Mar. 14, 2000 (KR) ..... 00-12640

(51) Int. Cl.[7] ..... F25B 43/02
(52) U.S. Cl. ..... 62/469; 62/84; 62/475; 62/470
(58) Field of Search ..... 62/84, 475, 469, 62/470

(56) References Cited

U.S. PATENT DOCUMENTS 5,159,820 * 11/1992 Ohishi et al. ..... 62/468
5,182,919 * 2/1993 Fujiwara ..... 62/193
5,396,784 * 3/1995 Huenniger ..... 62/471
5,603,223 * 2/1997 Murray et al. ..... 62/84
5,675,978 * 10/1997 Hamm, Jr. et al. ..... 62/84
5,911,743 * 6/1999 Shaw ..... 62/84
6,018,962 * 2/2000 Dewhirst et al. ..... 62/468
6,134,898 * 10/2000 Umemura et al. ..... 62/193
6,170,286 * 1/2001 Keuper ..... 62/471

* cited by examiner

*Primary Examiner*—William Doerrler
*Assistant Examiner*—Mark Shulman

(57) ABSTRACT

An internal oil separator for compressors of refrigeration systems is disclosed. This oil separator supplies an effective quantity of lubrication oil to the drive parts of a compressor, and protects the compressor from being unexpectedly damaged or locked. The oil separator accomplishes the recent trend of compactness of compressors, and prevents a bypass flow of the compressed refrigerant into the compressor. This oil separator collaterally reduces operational noises of the compressor. In this oil separator, an oil-separating chamber 21, having a generally U-shaped passage, is defined in the rear section of a compressor housing by a cover 2. The oil-separating chamber 21 has a guide wall 22, thus forming a desired U-shaped passage therein. Refrigerant inlet and outlet ports 13, 14 are formed on the rear wall of the housing. An oil-collecting part 17 is formed on the bottom of the oil-separating chamber 21 and stores recovered oil therein. This oil-collecting part 17 communicates with an oil return line 16 through an oil return channel 31 of a gasket 3, and so the recovered oil returns to the driving part chamber 18 of the compressor. The above gasket 3 is interposed between the housing 1 and the cover 2, thus accomplishing a desired sealing effect. An oil-separating plate 4 and/or a screen member 5 formed by single loop structure is preferably set within the oil-separating chamber 21.

8 Claims, 17 Drawing Sheets

INTERNAL OIL SEPARATOR FOR COMPRESSORS OF REFRIGERATION SYSTEMS

BACKGROUND OF THE INVENTION

1. Field of the Invention

The present invention relates, in general, to an oil separator for compressors of automobile refrigeration systems and, more particularly, to an internal oil separator installed within the compressor of such a refrigeration system and used for separating and recovering lubrication oil from discharged gas refrigerant before the refrigerant is discharged from the compressor through a refrigerant discharge line and feeding the recovered oil back to the frictional parts of the compressor.

2. Description of the Prior Art

As well known to those skilled in the art, a refrigeration system for automobiles typically comprises a compressor, a condenser, an expansion valve and an evaporator. In such a refrigeration system, the compressor adiabatically compresses low temperature and low pressure gas refrigerant, thus forming high temperature and high pressure gas refrigerant prior to discharging the refrigerant to a condenser. The condenser condenses the high temperature and high pressure gas refrigerant from the compressor through a heat exchanging process, thus forming saturated liquid refrigerant. The expansion valve throttles the saturated liquid refrigerant from the condenser, thus allowing the refrigerant to become a saturated wet vapor phase having low pressure. In the evaporator, the refrigerant from the expansion valve absorbs heat from its surroundings, thus becoming a saturated gaseous phase prior to returning to the compressor.

In such a refrigeration system for automobiles, the compressor is operated by the rotating force of the engine, which is selectively transmitted thereto through a pulley under the control of an electromagnetic clutch. The compressor thus sucks the saturated gas refrigerant from the evaporator and compresses the refrigerant by a rectilinear reciprocating action of a piston prior to discharging the refrigerant to the condenser. Such compressors have been typically and generally classified into two types, that is, reciprocating compressors and rotary compressors, in accordance with both the refrigerant compression styles and the structures of the compressors. In addition, the reciprocating compressors have been classified into two types, swash plate compressors and wobble plate compressors. On the other hand, the rotary compressors have been classified into two types, vane rotary compressors and scroll compressors.

A swash plate compressor comprises a front housing, and a rear housing assembled with the front housing into a single housing. A front cylinder is installed within the front housing, while a rear cylinder is installed within the rear housing. A plurality of double-head pistons are movably positioned within the bores of the front and rear housing so as to rectilinearly reciprocate relative to the bores. A drive shaft is rotatably installed in the compressor while passing through the central portions of the front and rear housings and the front and rear cylinders. A swash plate is inclinedly mounted to the drive shaft and is rotated along with the drive shaft, thus allowing the double-head pistons to rectilinearly reciprocate relative to the bores of the cylinders. A valve unit is installed in the gap between each of the front and rear cylinders and the interior surface of an associated one of the front and rear housings.

When the rotating force of an engine is applied to the drive shaft of the above swash plate compressor, the swash plate is rotated along with the drive shaft, thus allowing the double-head pistons to rectilinearly reciprocate within the bores of the front and rear cylinders. During such a reciprocating action of the pistons, refrigerant is sucked into the bores of the cylinders through a valve unit in the case of a suction stroke of the cylinders. On the other hand, refrigerant is compressed and discharged from the bores of the cylinders through another valve unit in the case of an discharge stroke of the cylinders.

In order to allow such a swash plate compressor to be smoothly operated, it is necessary to make refrigerant laden with lubrication oil. In such a case, the lubrication oil effectively circulates along with the refrigerant through the drive parts within the compressor during an operation of the refrigeration system, thus lubricating the gaps between the mechanically frictional drive parts within the compressor, such as the gaps between the pistons and cylinder bores.

When such lubrication oil circulates along with refrigerant within the refrigeration system as described above, the oil passes through the heat exchangers, such as the condenser and evaporator, and through the expansion valve and a variety of pipes and hoses. The oil is thus undesirably coated on the interior surfaces of the refrigerant passages within the refrigeration system and consumes the space of the interior cavity of the parts of the system, particularly, the heat exchangers. This finally reduces the fluidity of refrigerant within the refrigeration system in addition to a reduction in heat exchanging effect of the refrigeration system. Such a coated oil layer also increases the pressure drop within the heat exchangers, and so the operational effect of the refrigeration cycle is deteriorated. On the other hand, the circulation of oil through all the parts of the refrigeration system inevitably results in a variation in the amount of oil laden in the refrigerant fed to the compressor. Therefore, lubrication oil fails to be sufficiently supplied to the drive parts within the compressor, and so it is almost impossible to accomplish a desired lubrication effect for the frictional drive parts of the compressor. This causes such frictional drive parts of the compressor to be operated without being effectively lubricated, thus finally causing frictional damage or breakage of the drive parts and reducing the durability of the compressor. When refrigerant is laden with a large quantity of lubrication oil so as to allow the drive parts of the compressor to be sufficiently lubricated, the refrigerant may lose its intrinsic refrigerating function due to the oil. This finally reduces the refrigerating operational efficiency of the refrigeration system and increases the size of the system. It is difficult to design such an enlarged refrigeration system or to install the system at a limited area within the engine compartment of an automobile.

In an effort to overcome the above-mentioned problems, the automobile refrigeration systems are typically provided with oil separators for separating and recovering lubrication oil from discharged gas refrigerant of a compressor and feeding the recovered oil back to the compressor.

Such oil separators for compressors have been typically classified into two types, internal oil separators installed within compressors and external oil separators installed outside the compressors, in accordance with the position of the oil separators relative to the compressors. The two types of oil separators respectively have advantages and disadvantages as follows.

FIG. 16 is a circuit diagram of a refrigeration system provided with a conventional external oil separator. As shown in the drawing, the external oil separator 110 is installed on a refrigerant discharge line 112 outside the compressor 100, and so the external oil separator 110 is so-called "a refrigerant discharge line oil separator" in the art. Such an oil separator 110 separates and recovers lubrication oil from refrigerant discharged from the compressor 100 through the discharge line 112 and stores the recovered oil in its oil chamber, and feeds the recovered oil back to the refrigerant suction line 111 of the compressor 100 through an oil flow controller (not shown), such as a capillary tube. The above oil separator 110 thus allows the lubrication oil to repeatedly circulate within the compressor 100 so as to lubricate the drive parts (not shown) of the compressor 100 without being fed to the other parts of the refrigeration system. In the drawing, the reference numerals 130, 140, 150 and 160 respectively denote a condenser, a receiver drier, an expansion valve and an evaporator of the refrigeration system.

In a brief description, the external oil separator 110 separates and recovers lubrication oil from discharged refrigerant of the compressor 100 and bypasses the recovered oil to the oil suction line 111 of the compressor 100 through a bypass line 113.

Such an external oil separator 110 is advantageous in that the separator 110 is somewhat easy to design and produce and to accomplish a desired oil separating and recovering effect. However, the external oil separator 110 is problematic in that it is necessarily provided with a bypass line 113 consuming the space within the refrigeration system.

Meanwhile, several types of internal oil separators have been proposed and selectively used with different types of compressors.

An example of conventional internal oil separators for compressors is referred to an oil separator disclosed in Japanese Patent Laid-open Publication No. Heisei. 5-240158. As shown in FIG. 17, this Japanese internal oil separator comprises an oil-storing chamber 122, which separates and recovers lubrication oil from refrigerant discharged from the cylinder bore of a compressor 120 and primarily stores the recovered oil therein. An oil supply chamber 124 is formed in parallel to the oil-storing chamber 122 and receives the recovered oil discharged from the oil-storing chamber 122 through an oil line 123 due to a pressure difference between the two chambers 122 and 124, thus secondarily storing the oil therein. An oil return line 126 connects the oil supply chamber 124 to a driving part chamber 128 formed within the lower portion of an oil separator housing 121, thus guiding the recovered oil from the oil supply chamber 124 to the driving part chamber 128. An oil flow control valve 125 is installed on the inlet port of the oil return line 126 so as to control the quantity of inlet oil for the line 126. In such an internal oil separator, it is necessary to parallely form the two chambers, or the oil-storing chamber 122 and the oil supply chamber 124, within the housing 121, and so the oil-storing chamber 122 is undesirably limited in its size. This finally limits the oil storage capacity of the oil-storing chamber 122. When the size of the oil-storing chamber 122 is enlarged to store a desired quantity of oil therein, the size of the compressor 120 is also enlarged. However, it is difficult to install such a large-sized compressor 120 at a limited area within the engine compartment of an automobile. In addition, when the automobile is moved to the left or right so as to inclinedly position the compressor 120 while running on bumpy road, the surface of recovered oil 127 within the oil-storing chamber 122 changes from a horizontal position "A" to an inclined position "B" as shown in FIG. 17 while opening the inlet port 129 of the oil line 123 extending between the two chambers 122 and 124. When the inlet port 129 of the oil line 123 is opened as described above, gas refrigerant in place of recovered oil is undesirably introduced into the driving part chamber 128 through the open inlet port 129. In such a case, the compressor 120 is seriously damaged.

In the prior art, several types of internal oil separators for compressors in addition to the above Japanese oil separator have been proposed and used. However, such internal oil separators are designed to be operated under the operational theory similar to that of the above Japanese oil separator, and so it is possible for those skilled in the art to effectively understand the construction and operation of the internal oil separators from the following simple description without reference to the drawings.

In an internal oil separator for compressors disclosed in Japanese Patent Laid-open Publication No. Heisei. 3-129273, a cylindrical cavity is formed within a compressor and is used for guiding compressed and oil-laden gas refrigerant from the compressor into an oil-separating chamber. This oil-separating chamber has an inlet port, through which the oil-separating chamber is connected to the cylindrical cavity. The oil-separating chamber also has an outlet port and is connected to an oil-storing chamber through an oil guide line extending from the outlet port. The oil-storing chamber is used for storing recovered oil therein. Both the oil-separating chamber and the oil-storing chamber are integrated with the compressor into a single structure. Therefore, when the compressed and oil-laden gas refrigerant circulates within the oil-separating chamber while flowing along the internal surface of that chamber, the lubrication oil is separated and recovered from the refrigerant and is guided to the oil-storing chamber prior to being fed back to the suction port of the compressor. In such a case, the gas refrigerant free from lubrication oil is discharged from the compressor into a condenser through a refrigerant discharge line. However, this oil separator is problematic in that it is provided within the top portion of the compressor, thus increasing the size of the compressor and forcing the installation space for the compressor within the engine compartment of an automobile to be enlarged. This finally makes it difficult to design both the compressor and the engine compartment. In addition, since the compressed and oil-laden gas refrigerant flows along the internal surface of the oil-separating chamber while swirling on the surface so as to be centrifugally separated from the oil, the gas refrigerant flows within the oil-separating chamber at a high speed and may be discharged from the compressor along with the lubrication oil. That is, the lubrication oil may be not effectively recovered from the gas refrigerant by the oil separator, but may be undesirably discharged along with the gas refrigerant from the compressor into the condenser. This internal oil separator is thus reduced in oil recovering efficiency.

Another internal oil separator for vane compressors, disclosed in Japanese Patent Laid-open Publication No. Heisei. 7-151083, is designed to prevent a bypass flow of refrigerant within a compressor. In this oil separator, lubrication oil is separated and recovered from gas refrigerant within an oil-separating chamber and is stored within an oil-storing chamber. The gas refrigerant free from oil is discharged from the compressor into a condenser through a refrigerant discharge line. A line control means is installed on the refrigerant discharge line so as to automatically close the line when a rotor is stopped. This oil separator is positioned within the rear section of the compressor. However, the two chambers of this oil separator, or the oil-separating chamber and the oil-storing chamber, exceedingly consume the rear section of the interior space of the compressor, and so this oil separator undesirably increases the size of the compressor. Another problem of this oil separator resides in that it centrifugally separates lubrication oil from gas refrigerant by use of a high speed swirling action of the compressed and oil-laden gas refrigerant within the oil-separating chamber, thus being reduced in oil recovering efficiency in the same manner as that described for the oil separator disclosed in Japanese Patent Laid-open Publication No. Heisei. 3-129273.

Conventional internal oil separators for scroll compressors may be referred to Japanese Patent Laid-open Publication Nos. Heisei. 11-82335, 11-82338, 11-82351, 11-82352 and 11-93880. In the internal oil separators for scroll compressors, an oil-separating chamber is formed at the upper portion of the rear wall of the rear housing within a compressor. An oil-storing chamber, communicating with the oil-separating chamber and used for storing recovered oil therein, is provided between the rear housing and a cell. This oil-storing chamber also communicates with the sliding part between a fixed scroll and a movable plate. This oil separator is designed to centrifugally separate lubrication oil from gas refrigerant by use of a high-speed swirling action of the compressed and oil-laden gas refrigerant in the same manner as that described for the oil separators disclosed in Japanese Patent Laid-open Publication Nos. Heisei. 3-129273 and 7-151083. Therefore, the internal oil separators for scroll compressors are problematic in that lubrication oil may be not recovered from the gas refrigerant, but may be undesirably discharged along with gas refrigerant from the compressor into the condenser, thus being reduced in oil recovering efficiency. Another problem of the above internal oil separators for scroll compressors resides in that the compressor is necessarily enlarged in its length and is complicated in its construction due to both the oil-storing chamber provided between the rear housing and the cell and the oil-separating chamber provided at the upper portion of the rear wall of the rear housing within the compressor.

In an effort to overcome the above-mentioned problems, the inventor of this invention proposed an internal oil separator for compressors in Korean Patent Laid-open Publication No. 99-80933. In this Korean oil separator, both an oil-separating chamber and an oil-storing chamber are formed within a compressor by both the rear housing and the end cap of a compressor in a way such that the oil-separating chamber is positioned above the oil-storing chamber. The interior of the oil-separating chamber is partitioned into two parts by a guide wall, with a U-shaped passage being provided within the oil-separating chamber. In an operation of this oil separator, compressed and oil laden gas refrigerant circulates within the oil-separating chamber while forming a U-shaped circulation. During such a U-shaped circulation of the gas refrigerant within the oil-separating chamber, lubrication oil is centrifugally separated from gas refrigerant prior to being stored in the oil-storing chamber. The recovered oil is, thereafter, fed from the oil-storing chamber back to the driving part chamber of the compressor through an oil return line. In this oil separator, compressed and oil-laden gas refrigerant circulates within the oil-separating chamber while forming a U-shaped circulation, and so the lubrication oil, having a specific weight higher than that of the gas refrigerant, is more effectively separated from the refrigerant due to its weight and centrifugal force. Therefore, this oil separator is improved in oil recovering efficiency and accomplishes the recent trend of compactness of compressors. However, this internal oil separator is problematic in that lubrication oil or gas refrigerant may leak from the junction between the end cap and the rear housing of the compressor. In addition, the recovered oil return line extends from the oil-storing chamber at a position of a considerable height above the bottom of that chamber and initially and horizontally feeds the recovered oil to the driving part chamber. Therefore, this oil separator may allow gas refrigerant to undesirably flow into the driving part chamber through the oil return line in the case of a low level of recovered oil within the oil-storing chamber. Another disadvantage experienced in the above Korean oil separator resides in that the recovered oil is introduced from the oil-storing chamber into the lower portion within a driving part chamber, thus failing to effectively lubricate the moving parts within the driving part chamber. In addition, when an automobile is moved to the left or right so as to inclinedly position the compressor 120 while running on bumpy road, gas refrigerant may undesirably flow into the driving part chamber.

SUMMARY OF THE INVENTION

Accordingly, the present invention has been made keeping in mind the above problems occurring in the prior art, and an object of the present invention is to provide an internal oil separator for compressors of automobile refrigeration systems, which is designed to be always filled with an appropriate quantity of recovered lubrication oil within the lower portion of an oil-separating chamber, thus supplying a predetermined quantity of oil to the drive parts of a compressor without failure even in the case of an unexpected inclined position of the compressor, and which is designed to allow compressed gas refrigerant laden with lubrication oil to pass through a generally U-shaped passage prior to being discharged from the compressor, thus allowing the oil to be more effectively and almost completely separated and recovered from the refrigerant, and which thus finally protects the compressor from being unexpectedly damaged and prevents the drive shaft of the compressor from being unexpectedly locked, and improving the durability of the compressor.

Another object of the present invention is to provide an internal oil separator for compressors of automobile refrigeration systems, which has a thin plate-type profile capable of being simply and easily embedded within the rear section of a compressor housing without enlarging the compressor, thus accomplishing the recent trend of compactness of compressors.

A further object of the present invention is to provide an internal oil separator for compressors of automobile refrigeration systems, which is designed to be always filled with an appropriate quantity of recovered oil within the oil-storing chamber so as to prevent the recovered oil return line of the oil separator from being exposed to compressed gas refrigerant discharged from the compressor, thus preventing a bypass flow of the compressed refrigerant into the compressor.

Still another object of the present invention is to provide an internal oil separator for compressors of automobile refrigeration systems, which is designed to collaterally reduce operational noises, such as gas pulsation noises, of a compressor, thus allowing the compressor to be free from irritating passengers of an automobile.

In order to accomplish the above object, the present invention provides an internal oil separator for compressors of refrigeration systems, comprising: an oil-separating chamber having a generally U-shaped refrigerant flowing passage and being formed in the rear section of a compressor housing while being closed by an oil separator cover mounted to the rear wall of the compressor housing, with refrigerant suction and discharge ports being formed abreast on the top end of the compressor housing, the suction port being used for introducing gas refrigerant from an evaporator into a compressor and the discharge port being used for discharging compressed gas refrigerant from the compressor into a condenser; a refrigerant inlet port formed on the rear wall of the compressor housing and used for introducing compressed and oil-laden gas refrigerant into the oil-separating chamber; a refrigerant outlet port formed on the rear wall of the compressor housing and used for discharging compressed gas refrigerant, separated from oil, from the oil-separating chamber into the refrigerant discharge port; an oil-collecting part formed on the bottom of the oil-separating chamber by partially depressing the bottom of the oil-separating chamber, the oil-collecting part being used for storing oil separated and recovered from the oil-laden refrigerant flowing within the oil-separating chamber; an oil return line extending from the upper portion of the rear wall of the compressor housing and used for returning the recovered oil from the oil-collecting part into the refrigerant suction port; and a gasket tightly interposed between the compressor housing and the oil separator cover so as to seal the junction between the housing and the cover, with an oil return passage being formed on the gasket by cutting the gasket at a predetermined position, the oil return passage connecting the oil-collecting part to the oil return line.

In the above internal oil separator, the oil-separating chamber is formed by both a first depression, having a closed curve profile similar to a circular or elliptical profile and being formed on the rear wall of the compressor housing, and a second depression, having the same profile as that of the first depression and being formed on the inside surface of the oil separator cover, with a guide wall part consisting of both a first guide wall, downwardly extending from the center of the upper portion of the first depression toward the oil-collecting part to a length, and a second guide wall formed on the second depression so as to correspond to the first guide wall, the guide wall part allowing the oil-separating chamber to have the generally U-shaped refrigerant flowing passage.

On the other hand, the oil-collecting part is formed by both a first oil-collecting groove, formed on the bottom of the first depression, and a second oil-collecting groove formed on the bottom of the second depression at a position corresponding to the first oil-collecting groove.

In addition, an oil-separating plate, having a plurality of holes, may be horizontally set within the oil-separating chamber at a position above the oil-collecting part, thus dividing the oil-separating chamber into an upper section, or an oil-separating section, and a lower section, or an oil-storing section. This oil-separating plate may be integrated with the gasket at its opposite ends into a single structure.

In the above internal oil separator, a screen member, or a loop-type member fabricated by integrating two filtering nets into a loop using two webs, may be vertically positioned within the oil-separating chamber in a way such that the nets are respectively directed to the rear wall of the compressor housing and the inside surface of the oil-separator cover. Within the oil-separating chamber, both the upper web and the upper end portions of the nets surround the inlet port of the compressor housing. The opposite nets of the net member preferably act in place of filters for a variety of foreign particular substances, while the lower web of the net member defines a foreign substance-storing chamber.

In the present invention, the oil-separating chamber may be formed by a depression, having a closed curve profile similar to a circular or elliptical profile and being formed only on an inside surface of the oil separator cover.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
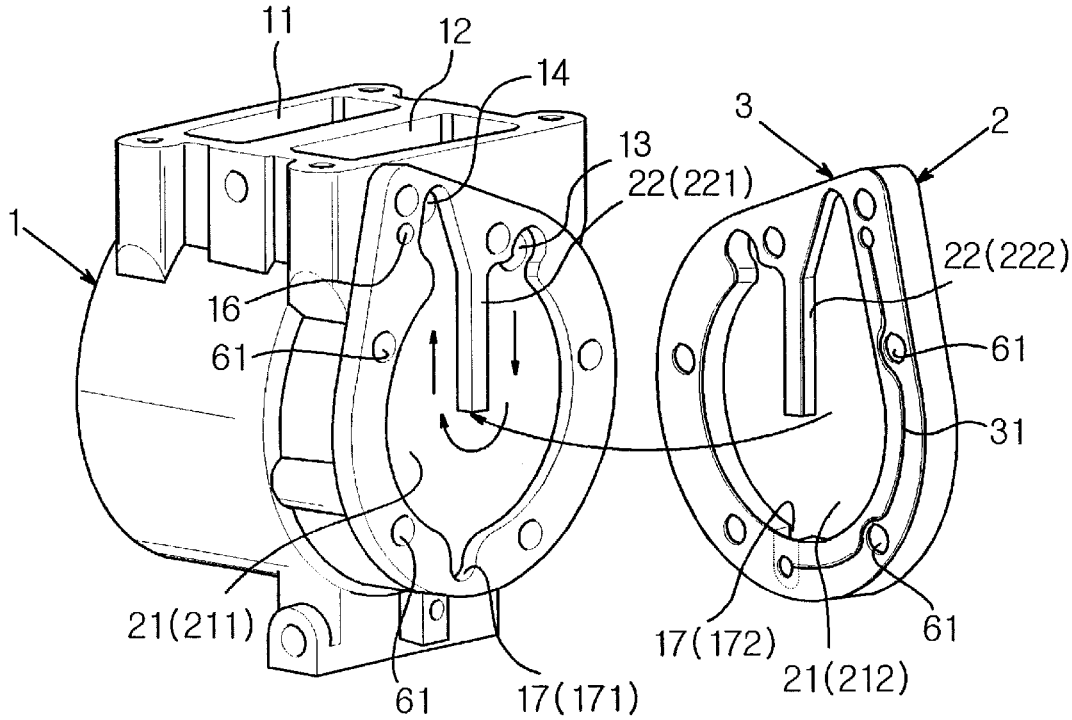
FIG. 1 is an exploded perspective view of a compressor for automobile refrigeration systems embedded with an internal oil separator in accordance with the primary embodiment of the present invention.
Figure 2:
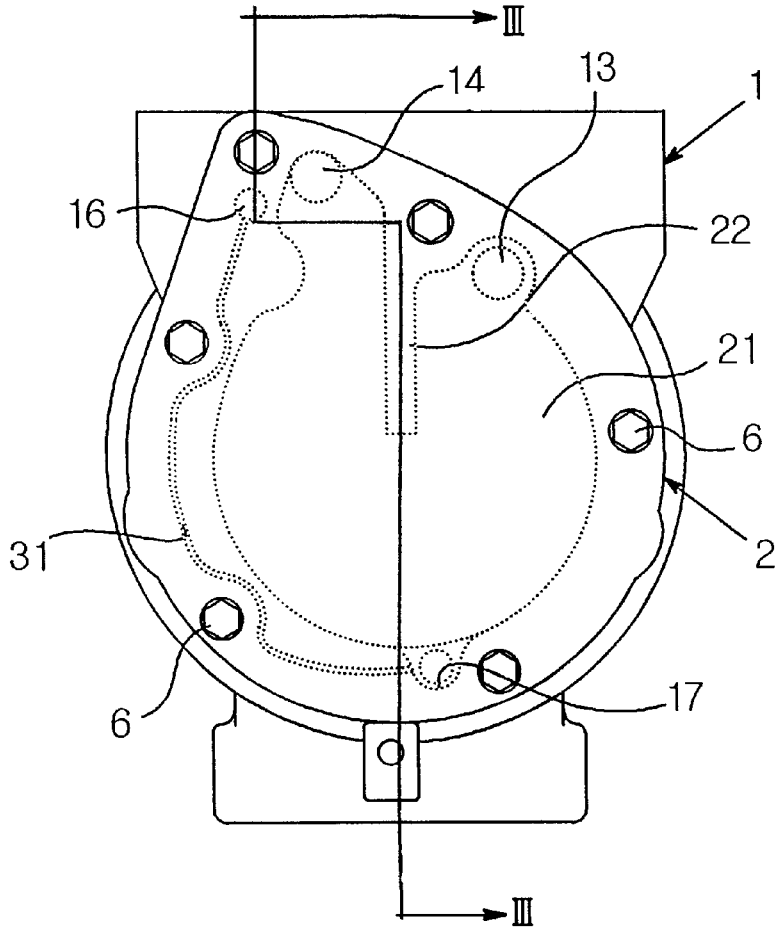
FIG. 2 is a partially opened-up rear view of the compressor of FIG. 1 showing the oil separator embedded in the compressor.

FIGS. 1 to 6 show an internal oil separator embedded in a compressor for automobile refrigeration systems in accordance with the primary embodiment of the present invention. The construction of the above internal oil separator will be described hereinbelow in conjunction with the drawings. For ease of description, the end of a compressor housing 1, or a rear housing of the compressor, on the left-hand side of FIG. 3 will be referred to as the forward end of the housing 1 and the opposite end on the right-hand side of FIG. 3 will be referred to as the rear end of the housing 1. In the same manner, the end of the compressor housing 1 on the left-hand side of FIG. 2 will be referred to as the left end of the housing 1 and the opposite end on the right-hand side of FIG. 2 will be referred to as the right end of the housing 1.

As shown in the drawings, the compressor housing 1 has two ports, or refrigerant suction and discharge ports 11 and 12, at its top end. The suction port 11 introduces gas refrigerant from an evaporator (not shown) into the compressor housing 1, while the discharge port 12 discharges compressed gas refrigerant from the compressor housing 1 into a condenser (not shown) . The two ports 11 and 12 are parallely formed abreast on the top end of the housing 1. The forward part of the housing 1 has an opening, while the rear part of the housing 1 is closed. The opening, formed in the forward part of the housing 1, defines a driving part chamber 18 for seating a plurality of drive parts used for compressing the refrigerant within the housing 1.

The refrigerant discharge port 12 has a sectional area considerably larger than that of a refrigerant outlet port 14 connecting the discharge port 12 to an oil-separating chamber 21 of the oil separator. In an operation of the compressor, gas refrigerant is discharged from the compressor housing 1 into the condenser through the discharge port 12, having a large sectional area, after passing through the outlet port 14 having a small sectional area. Therefore, the gas refrigerant is desirably dropped in its pressure due to an adiabatic expansion while being discharged from the compressor housing 1 into the condenser. This housing 1 thus effectively reduces operational noises, such as gas pulsation noises, of the compressor and allows the compressor to be free from irritating passengers of an automobile as will be described in detail later herein.

The internal oil separator according to the primary embodiment of this invention is designed to receive compressed and oil-laden gas refrigerant and to separate and recover the lubrication oil from the gas refrigerant prior to feeding the recovered oil back to the driving part chamber 18 within the compressor housing 1. In such a case, the compressed gas refrigerant free from lubrication oil is discharged from the housing into the condenser through the discharge port 12. In order to accomplish the above object, the oil separator of this invention has an oil separator cover 2 mounted to the rear wall of the housing 1, with an oil-separating chamber 21 being defined between the rear wall of the housing 1 and the cover 2. That is, a first depression 211, having a closed curve profile similar to a circular or elliptical profile, is formed on the rear wall of the compressor housing 1. A second depression 212, having the same profile as that of the first depression 211, is formed on the inside surface of the cover 2. When the cover 2 is mounted to the rear wall of the housing 1, the two depressions 211 and 212 form a desired oil-separating chamber 21 within the compressor.

A guide wall part 22 vertically extends from the center of the upper portion of the oil-separating chamber 21 to the central portion of the chamber 21, thus forming a generally U-shaped refrigerant flowing passage within the chamber 21. That is, a first guide wall 221 vertically extends from the center of the upper portion of the first depression 211 to the central portion of said depression 211, while a second guide wall 222 vertically extends from the center of the upper portion of the second depression 212 to the central portion of said depression 212 at a position corresponding to the first guide wall 221. Therefore, when the cover 2 is mounted to the rear wall of the compressor housing 1, the two guide walls 221 and 222 are brought into close contact with each other, thus forming a desired guide wall part 22 defining a generally U-shaped passage within the oil-separating chamber 21.

Figure 3:
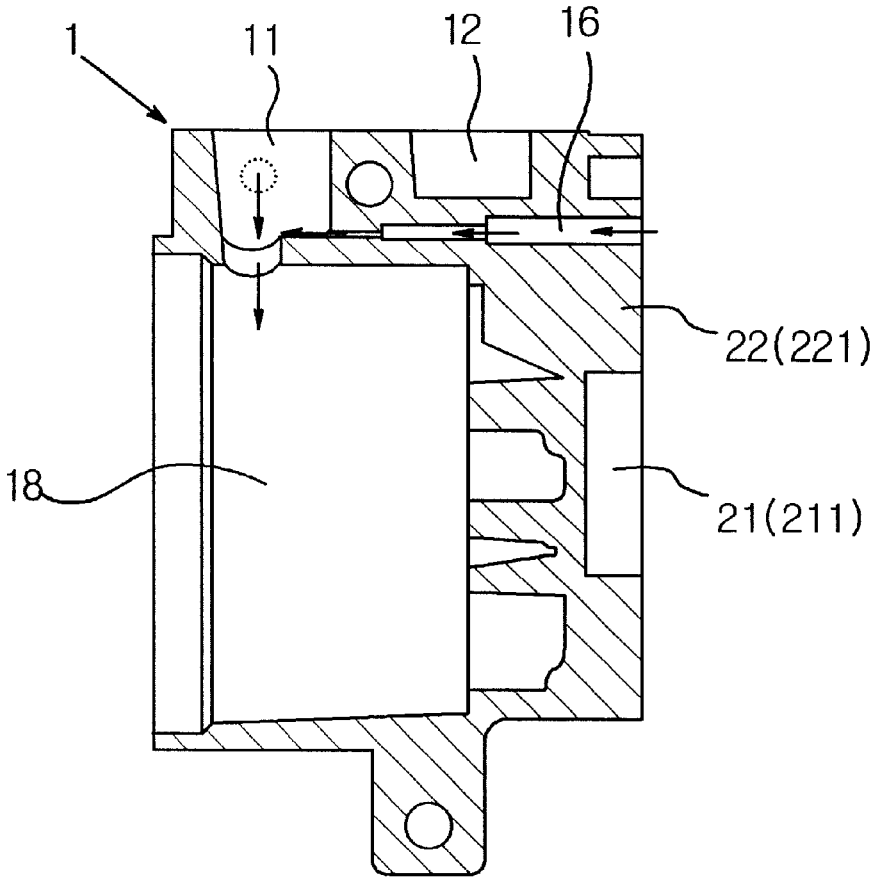
FIG. 3 is a sectional view of a compressor housing taken along the line III—III of FIG. 2.
Figure 4:
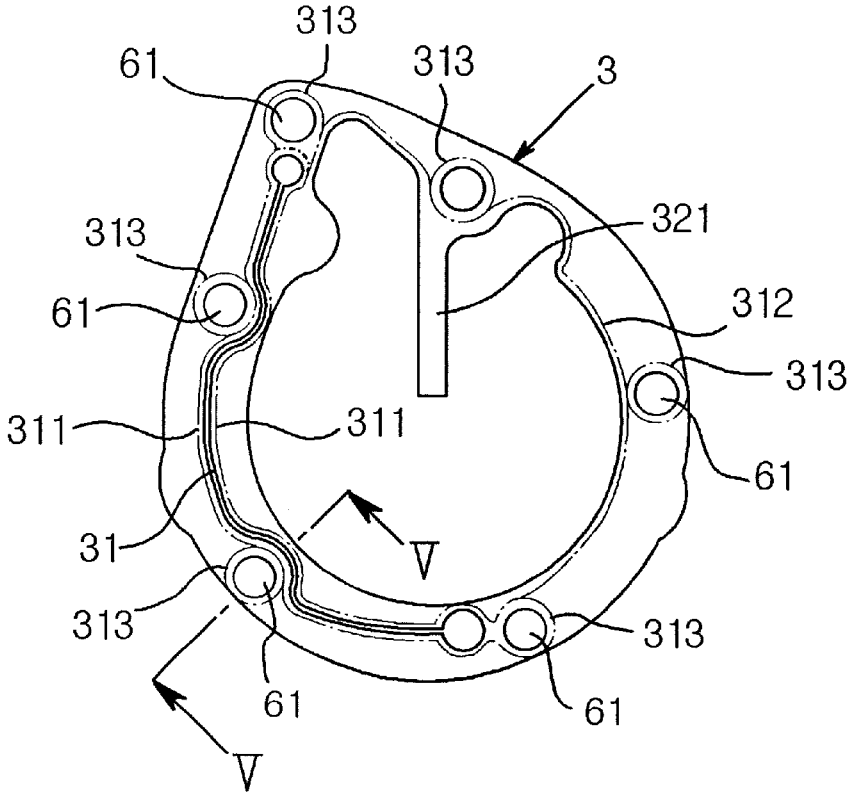
FIG. 4 is a rear view of a gasket included in the oil separator of FIG. 1.
Figure 5:
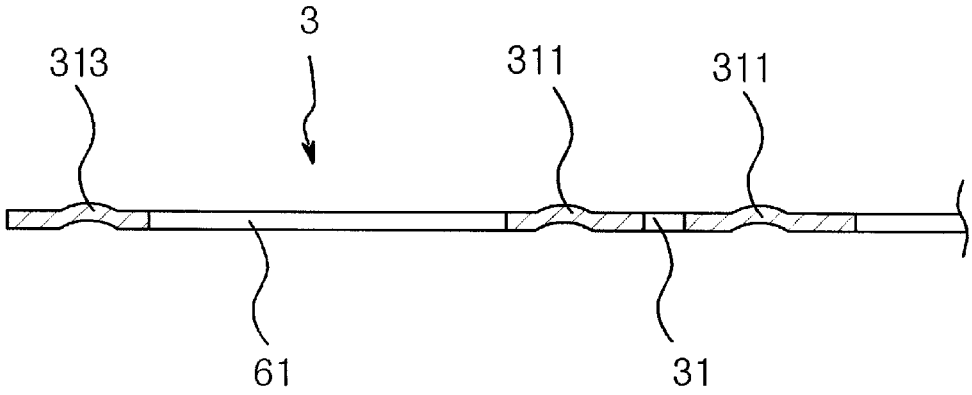
FIG. 5 is a sectional view of the gasket taken along the line V—V of FIG. 4.
Figure 6:
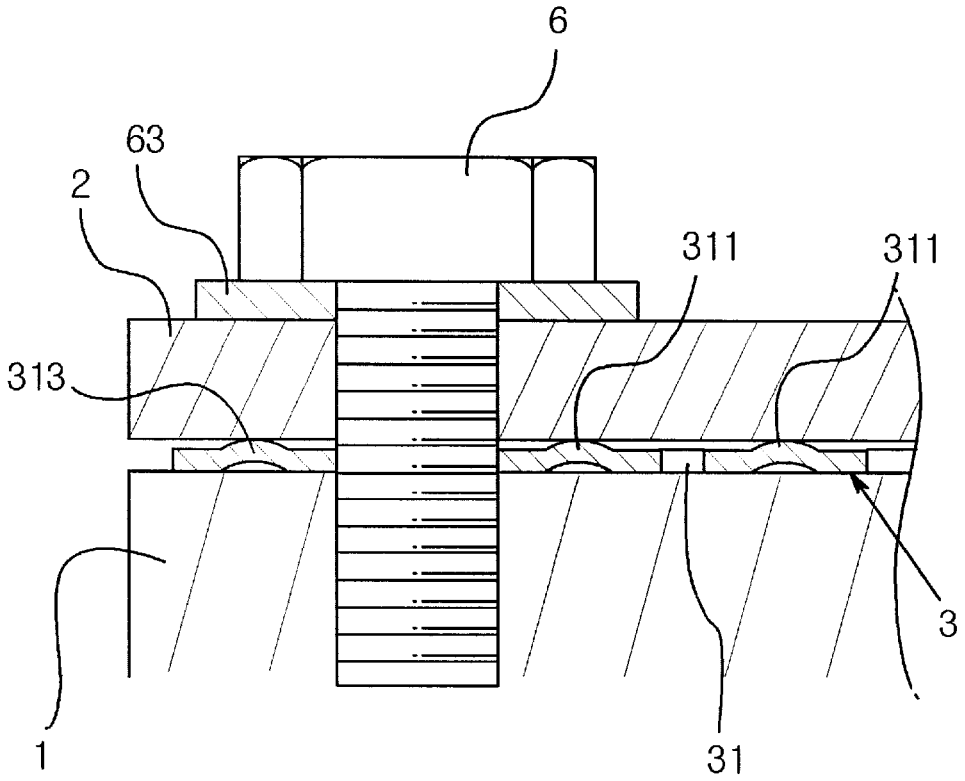
FIG. 6 is a sectional view, showing the gasket of FIG. 5 interposed between the compressor housing and an oil separator cover while being tightened by a locking bolt.

Due to the closed curve profile of the two depressions 211 and 212 similar to a circular or elliptical profile, the U-shaped passage of the oil-separating chamber 21 does not have a genuine U-shaped profile, but has a specifically designed U-shaped profile bulged at opposite side surfaces thereof as shown in FIGS. 3 and 4. Such a specifically designed U-shaped profile of the passage within the oil-separating chamber 21 has an advantage as will be described later herein.

The bottom of the oil-separating chamber 21 has a depression used as an oil-collecting part 17. That is, a first oil-collecting groove 171 is formed at the bottom of the first depression 211, while a second oil-collecting groove 172 is formed at the bottom of the second depression 212. When the cover 2 is mounted to the housing 1, the two oil-collecting grooves 171 and 172 form a desired oil-collecting part 17.

As described above, the internal oil separator of this invention is characterized in that it allows the compressed gas refrigerant, laden with lubrication oil, to pass through the oil-separating chamber 21 prior to being discharged from the housing 1 into the condenser through the discharge port 12. The oil-separating chamber 21 separates and recovers lubrication oil from the gas refrigerant prior to feeding the recovered oil back to the driving part chamber 18 of the compressor. The oil separator thus finally allows the compressed gas refrigerant free from lubrication oil to be discharged from the housing 1 into the condenser. In order to accomplish the above object, a refrigerant inlet port 13 is formed on the rear wall of the housing 1 while being opened toward the cover 2 at a position above the right-hand side of the first depression 211. This inlet port 13 introduces compressed and oil-laden gas refrigerant into the oil-separating chamber 21. On the other hand, a refrigerant outlet port 14 is formed on the rear wall of the housing 1 at a position above the left-hand side of the first depression 211. This outlet port 14 discharges compressed gas refrigerant, separated from lubrication oil, from the oil-separating chamber 21 into the discharge port 12. In a brief description, the inlet port 13 acts as an inlet port of the U-shaped passage of the oil-separating chamber 21, while the outlet port 14 acts as an outlet port of the U-shaped passage of the above chamber 21.

In order to prevent an unexpected leakage of compressed and oil-laden gas refrigerant within the chamber 21, or recovered lubrication oil from the compressor housing 1, a gasket 3 is tightly interposed between the rear wall of the housing 1 and the cover 2. The above gasket 3 also defines an oil return passage used for feeding recovered oil from the oil-separating chamber 21 into the driving part chamber 18. An oil return line 16 extends from the upper portion of the rear wall of the housing 1 at a left-hand side to the refrigerant suction port 11 of the compressor housing 1.

In order to allow the gasket 3 to accomplish a desired leakage preventing effect, the gasket 3 has an opening corresponding to that of the oil-separating chamber 21. That is, the gasket 3 has an opening corresponding to that of the first depression 211 of the housing 1 or of the second depression 212 of the cover 2. The above gasket 3 is positioned around the chamber 21, with an oil return channel 31 being formed along an edge portion, or a left-hand edge portion of the gasket 3, so as to connect the oil-collecting part 17 to the oil return line 16. A plurality of bolt holes 61 are formed on the gasket 3 at positions corresponding to those of both the housing 1 and the cover 2. An extension 321, having a shape corresponding to both guide walls 221 and 222 of the housing 1 and cover 2, extends from the center of the upper portion of the gasket 3 to the central portion of the gasket 3. The above extension 321 seals the junction between the two guide walls 221 and 222. As shown by the phantom lines in FIGS. 4 to 6, a first linear bead part 311 is formed along each edge of the oil return channel 31 of the gasket 3 while being projected toward the cover 2. A second linear bead part 312 extends from the first bead part 311 while being formed along the edge of the oil-separating chamber 21, thus forming a closed curve on the gasket 3 in cooperation with the first bead part 311. On the other hand, a third linear bead part 313 is formed around each of the bolt holes 61 of the gasket 3. The second and third bead parts 312 and 313 are projected toward the cover 2 in the same manner as that described for the first bead part 311. The cover 2 is tightly mounted to the rear wall of the compressor housing 1 using a plurality of locking bolts 6 passing through the bolt holes 61, with the gasket 3 precisely interposed between the housing 1 and the cover 2. In such a case, the first to third bead parts 311, 312 and 313 of the gasket 3 come into close contact with the inside surface of the cover 2, thus accomplishing a desired sealing effect for the junction between the housing 1 and the cover 2. In the present invention, it is more preferable to use a metal washer 63 with each locking bolt 6 and to tighten the locking bolts 6 in a way such that the washers 63 are brought into close contact with the outside surface of the cover 2. Such metal washers 63 further improve the sealing effect for the junction between the housing 1 and the cover 2.

In an operation of the compressor, compressed gas refrigerant, laden with lubrication oil, is introduced from the driving part chamber 18 into the oil-separating chamber 21 through the inlet port 13. The gas refrigerant flows through the U-shaped passage within the chamber 21, and so the lubrication oil is separated and recovered from the refrigerant and is collected into the oil-collecting part 17. In such a case, the interior pressure of the oil-separating chamber 21 is higher than that of the driving part chamber 18. Therefore, the recovered oil is fed from the oil-separating chamber 21 including the oil-collecting part 17 back into the driving part chamber 18 through both the oil return channel 31 of the gasket 3 and the oil return line 16 of the compressor housing 1 due to a pressure difference between the two chambers 18 and 21. The compressed gas refrigerant free from lubrication oil flows from the oil-separating chamber 21 into the discharge port 12 through the outlet port 14 prior to being discharged from the compressor into the condenser through the discharge port 12. In such a process, the oil-laden gas refrigerant circulating within the oil-separating chamber 21, the recovered oil collected within the oil-collecting part 17 and the recovered oil flowing to the oil return line 16 through the oil return channel 31 are free from leaking from the compressor housing 1 due to the sealing effect provided by the gasket 3. The above-mentioned operation of the oil separator of this primary embodiment will be described in detail later herein.

In the compressor housing 1, the refrigerant discharge port 12 is positioned in back of the refrigerant suction port 11. Therefore, the oil return line 16, connecting the oil-separating chamber 21 to the driving part chamber 18, extends under the lower portion of the discharge port 12 so as to reach the lower portion of the suction port 11 and communicates with the driving part chamber 18 through the suction port 11. Such an arrangement of the oil return line 16 is accomplished by making the suction port 11 deeper than the discharge port 12. Therefore, the recovered oil is discharged from the oil-collecting part 17 of the oil-separating chamber 21 into the suction port 11 through both the oil return channel. 31 of the gasket 3 and the oil return line 16 of the housing 1. At the suction port 11, the recovered oil flows into the driving part chamber 18 of the compressor along with gas refrigerant flowing from an evaporator into the compressor. In such a case, it is necessary to prevent the gas refrigerant, flowing from the evaporator, from being undesirably introduced into the oil-separating chamber 21 through the oil return line 16. This object may be accomplished by making the oil return line 16 having a multi-step structure, wherein the sectional area of the line 16 is gradually reduced in a direction from the oil return channel 31 to the suction port 11.

The operational effect of the internal oil separator according to the primary embodiment of this invention will be described in detail hereinbelow. Of course, this oil separator separates and recovers lubrication oil from compressed gas refrigerant prior to feeding the recovered oil back into the driving part chamber 18 of the compressor, and allows the compressed gas refrigerant free from lubrication oil to be discharged from the compressor into the condenser.

When the rotating force of a power source, such as an engine, is transmitted to the drive shaft of the compressor under the control of an electronic clutch, the drive parts of the compressor, such as pistons, vanes or scrolls, are operated to form a pressure difference within the compressor and allow gas refrigerant to flow from the evaporator into the driving part chamber 18 of the compressor through the refrigerant suction port 11. During such a refrigerant suction process, the recovered oil is fed from the oil-separating chamber 21, including the oil-collecting part 17, back into the lower portion of the suction port 11 through both the oil return channel 31 of the gasket 3 and the oil return line 16 of the compressor housing 1 due to a pressure difference between the two chambers 18 and 21. At the suction port 11, the recovered oil is introduced into the driving part chamber 18 of the compressor along with gas refrigerant flowing from the evaporator. Therefore, the oil-laden gas refrigerant within the driving part chamber 18 is compressed by the operation of the drive parts of the driving part chamber 18 and is discharged from the driving part chamber 18 into the upper portion of the right-hand side of the oil-separating chamber 21 through the refrigerant inlet port 13 extending from the driving part chamber 18 to the oil-separating chamber 21. When the compressed and oil-laden gas refrigerant is discharged from the driving part chamber 18 into the upper portion of the right-hand side of the oil-separating chamber 21 as described above, the gas refrigerant comes into primary collision against the inside surface of the cover 2, or the surface of the second depression 212 of the cover 2, thus being spattered on the cover 2. During such a spattering of the oil-laden gas refrigerant, lubrication oil, having a specific weight higher than that of the gas refrigerant, is primarily separated and recovered from the refrigerant and is attached to the inside surface of the oil-separating chamber 21. The primarily recovered oil flows down on the surface of the chamber 21 due to its weight, thus being collected in the oil-collecting part 17 and the lower portion of the chamber 21. In addition, the oil-laden gas refrigerant within the oil-separating chamber 21 also flows along the U-shaped passage, formed within the chamber 21 by the guide wall part 22, at a high speed so as to reach the refrigerant outlet port 14. During such a high-speed circulation along the U-shaped passage, the lubrication oil is secondarily and centrifugally separated and recovered from the refrigerant, thus being dropped into the lower portion of the oil-separating chamber 21. In addition, the U-shaped passage of the oil-separating chamber 21 does not have a genuine U-shaped profile, but has a specifically designed U-shaped profile bulged at opposite side surfaces thereof as best seen in FIGS. 3 and 4. Therefore, the primarily recovered oil, attached on the surface of the chamber 21 during the spattering of the gas refrigerant on the cover 2, is free from being trailed by the dynamic force of the oil-laden gas refrigerant flowing along the U-shaped passage within the chamber 21 or from being remixed with the refrigerant. This finally remarkably improves the oil separating efficiency of the oil separator of this invention.

In such an operation, the interior pressure of the oil-separating chamber 21 is higher than that of the driving part chamber 18, and so the recovered oil is fed from the oil-separating chamber 21, including the oil-collecting part 17, back into the refrigerant suction port 11 through both the oil return channel 31 of the gasket 3 and the oil return line 16 of the compressor housing 1 due to a pressure difference between the two chambers 18 and 21. At the suction port 11, the recovered oil is introduced into the driving part chamber 18 of the compressor along with gas refrigerant flowing from the evaporator. The drive parts within the driving part chamber 18 are thus effectively and continuously lubricated by the repeatedly recovered lubrication oil. During such a repeated circulation of lubrication oil within the compressor, the gas refrigerant, flowing from the evaporator, is prevented from being undesirably introduced into the oil-separating chamber 21 through the oil return line 16 since the oil return line 16 is connected to the lower portion of the suction port 11 and has a multi-step structure, with the sectional area of the line 16 being gradually reduced in a direction from the oil return channel 31 to the suction port 11.

On the other hand, the compressed gas refrigerant separated from lubrication oil flows from the oil-separating chamber 21 into the discharge port 12 through the outlet port 14 prior to being discharged from the compressor into the condenser through the discharge port 12. The internal oil separator of this primary embodiment accomplishes a remarkably improved oil recovering efficiency as described above, it allows the compressed gas refrigerant, discharged from the compressor into the condenser, to be less likely to include such lubrication oil. Therefore, this internal oil separator does not allow the lubrication oil to pass through heat exchangers, expansion valves or a variety of pipes and hoses of a refrigeration system, thus preventing the oil from being undesirably coated on the interior surfaces of the refrigerant passages within the refrigeration system or from consuming the space of the interior cavity of the parts included in the system. This finally improves the fluidity of refrigerant within the refrigeration system and improves the heat exchanging efficiency of the refrigeration system.

During such an oil recovering operation of the oil separator, oil-laden gas refrigerant flows along the U-shaped passage within the oil-separating chamber 21, thereby being primarily reduced in its flowing velocity. The oil-separating chamber 21 thus collaterally reduces the operational noises, such as gas pulsation noises, of the compressor and allows the compressor to be free from irritating passengers of an automobile.

In the internal oil separator according to the primary embodiment, the bottom of the oil-separating chamber 21 is depressed to form an oil-collecting part 17. Therefore, even when the chamber 21 is filled with recovered oil in a way such that the oil surface is only positioned just above the top end of the oil-collecting part 17, the inlet port of the oil return channel 31 of the gasket 3 is not exposed to the gas refrigerant flowing through the U-shaped passage within the oil-separating chamber 21. This finally prevents an undesirable bypass flow of the compressed gas refrigerant from the oil-separating chamber 21 into the driving part chamber 18. Such an operational effect of prevention of a bypass flow of the gas refrigerant from the oil-separating chamber 21 into the driving part chamber 18 is accomplished without failure even in the case of an abrupt inclination of the oil surface within the oil-separating chamber 21 due to an unexpected inclined position of the compressor or a running of an automobile on bumpy road. Due to the oil return channel 31 formed on the gasket 3, it is possible to almost completely prevent a bypass flow of the gas refrigerant from the oil-separating chamber 21 into the driving part chamber 18.

The internal oil separator according to the primary embodiment continuously recovers lubrication oil from compressed gas refrigerant and continuously supplies the recovered oil to the drive parts of the compressor, thus protecting said drive parts from being unexpectedly damaged or unexpectedly locked and improving the durability of the compressor. In addition, this oil separator prevents lubrication oil from circulating through all the parts of a refrigeration system, such as a condenser, an expansion valve and an evaporator, thus improving the heat exchanging efficiency of the refrigeration system and reducing the consumption of electric power of the system. Due to the oil-collecting part 17 formed at the bottom of the oil-separating chamber 21, it is possible to always supply an effective quantity of lubrication oil to the drive parts of the compressor even when a small quantity of recovered oil is filled in the oil-separating chamber. This finally reduces the amount of oil in charge in the compressor. This also allows a thin plate-type oil separator to be effectively used as the internal oil separator, thus reducing the size of the oil separator in addition to the size of the compressor housing 1. It is thus possible to accomplish the recent trend of compactness of compressors and to easily install the compressor within the engine compartment of an automobile. This finally allows such engine compartments to be somewhat freely designed.

In the internal oil separator of this primary embodiment, a gasket 3, having an opening corresponding to the oil-separating chamber, is interposed between the rear wall of the compressor housing 1 and the oil separator cover 2. First to third linear bead parts 311, 312 and 313 are formed on the gasket 3 while being projected toward the cover 2, thus being brought into close contact with the inside surface of the cover 2. Therefore, it is possible to prevent oil-laden gas refrigerant, flowing in the oil-separating chamber 21, or recovered lubrication oil, stored in the oil-collecting part 17, or recovered lubrication oil, flowing from the oil-collecting part 17 into the oil return line 16 of the housing 1 through the oil return channel 31 of the gasket 3, from leaking from the compressor. The above gasket 3 also prevents the recovered oil, flowing from the oil-collecting part 17 into the oil return line 16 through the oil return channel 31, from being remixed with the oil-laden gas refrigerant flowing within the oil-separating chamber 21.

Figure 7:
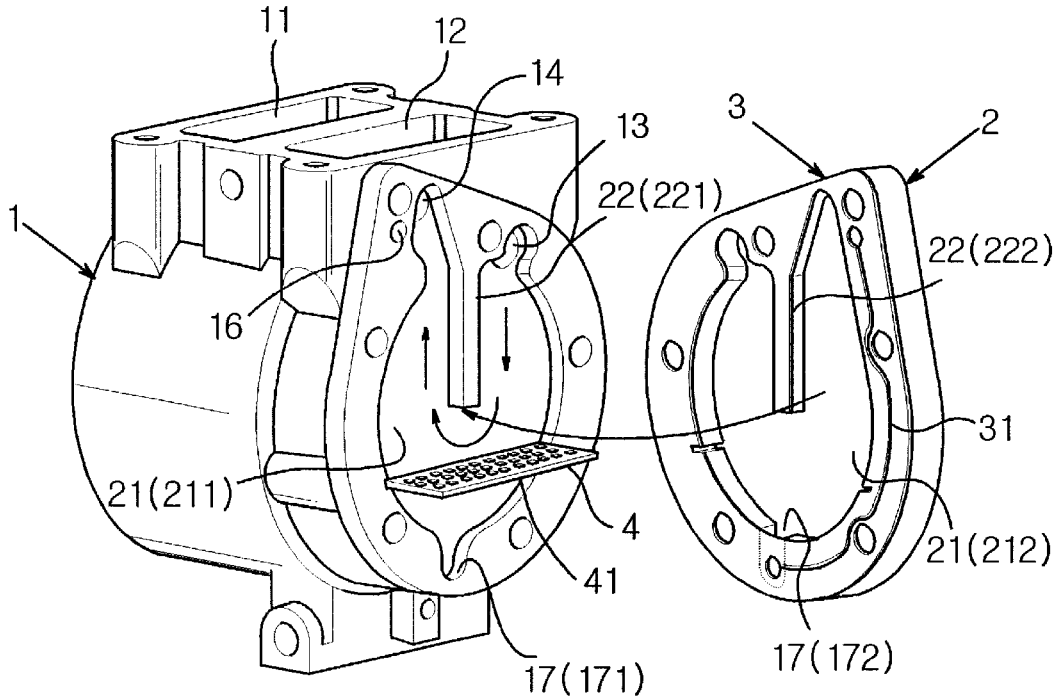
FIG. 7 is an exploded perspective view of a compressor for automobile refrigeration systems embedded with an internal oil separator in accordance with the second embodiment of the present invention.
Figure 8:
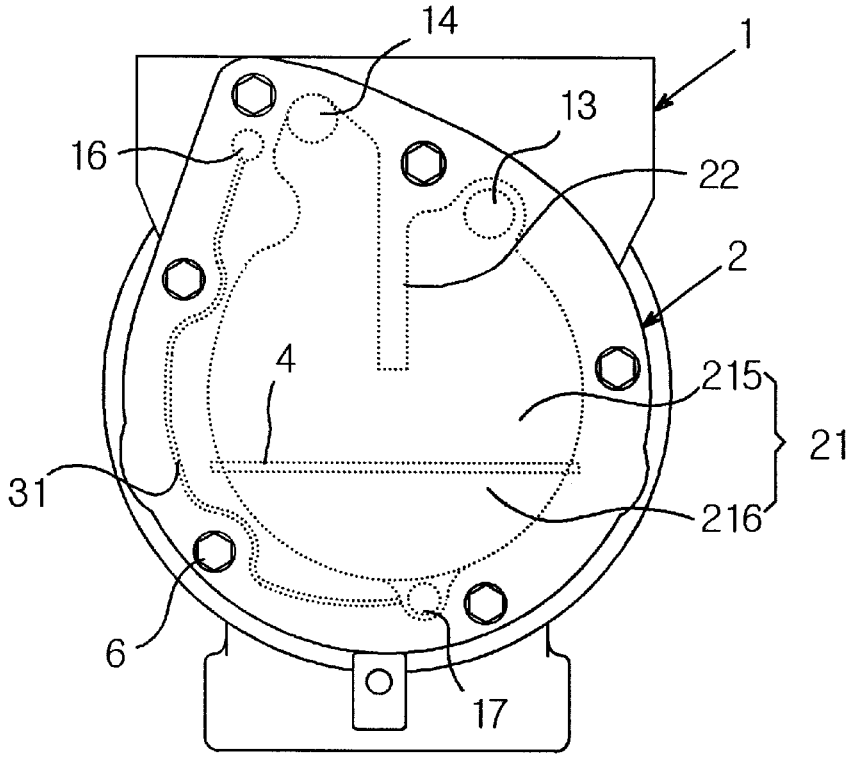
FIG. 8 is a partially opened-up rear view of the compressor of FIG. 7 showing the oil separator embedded in the compressor.
Figure 9:
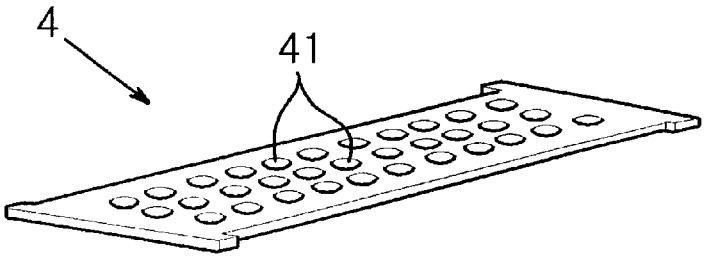
FIG. 9 is a perspective view of an oil-separating plate included in the oil separator of FIG. 7.

FIGS. 7 to 9 are views, showing an internal oil separator for compressors in accordance with the second embodiment of the present invention.

As shown in the drawings, the general shape of the oil separator according to the second embodiment remains the same as that described for the primary embodiment, but an oil-separating plate 4 is installed within the oil-separating chamber 21. In the following description for the second embodiment, it is thus not deemed necessary to further explain the construction or the operational effect of the same elements as those of the primary embodiment.

In the oil separator according to the second embodiment, the oil-separating plate 4 is a rectangular plate having a plurality of regular holes 41 and is horizontally set in the middle portion between the guide wall part 22 and the oil-collecting part 17 within the oil-separating chamber 21. The oil-separating plate 4 thus divides the interior of the oil-separating chamber 21 into upper and lower sections, or an oil-separating section 215 and an oil-storing section 216.

In an operation of the above oil separator, recovered lubrication oil, separated and recovered from the oil-laden gas refrigerant flowing through the U-shaped passage within the oil-separating chamber 21, passes through the holes 41 of the plate 4 prior to being stored within the oil-storing section 216 including the oil-collecting part 17. The above plate 4 cooperates with the recovered oil stored in the chamber 21, thus more effectively preventing gas refrigerant from being undesirably introduced into the oil return channel 31 of the gasket 3. This finally allows the oil separator to more effectively prevent a bypass flow of compressed gas refrigerant from the oil-separating chamber 21 into the driving part chamber 18. The above plate 4 also prevents the recovered oil from being undesirably trailed by the dynamic force of the oil-laden gas refrigerant, flowing along the U-shaped passage within the chamber 21, or from being discharged from the compressor into the condenser. This finally improves the oil separating efficiency of the oil separator. The above oil-separating plate 4 thus almost completely prevents a shortage of lubrication oil for the drive parts of the compressor, and so the durability of the compressor is enhanced.

Figure 10:
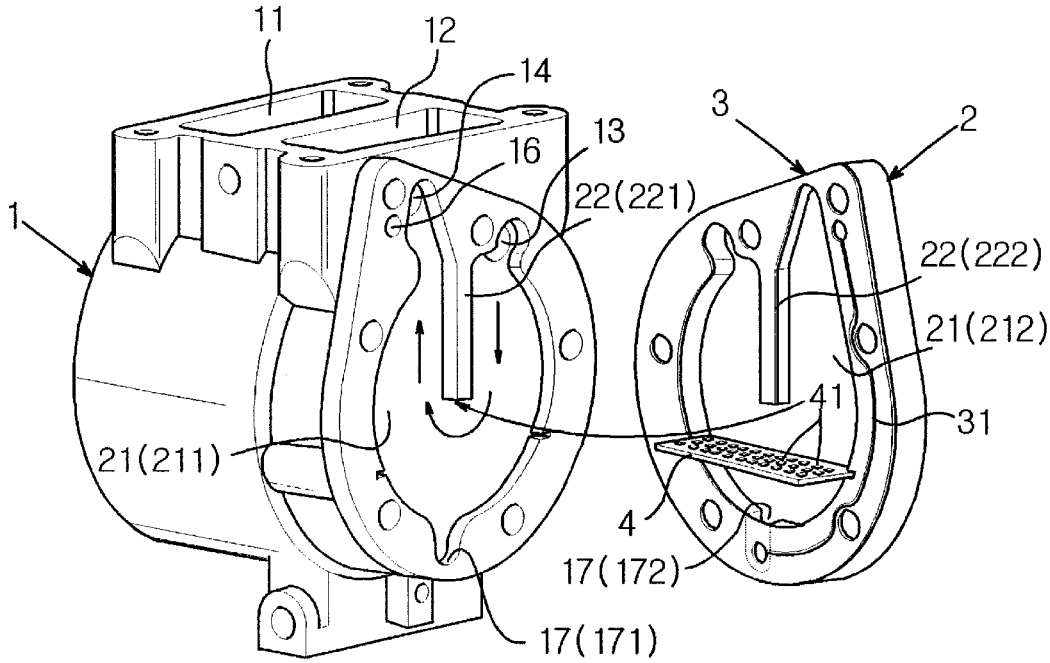
FIG. 10 is an exploded perspective view of a compressor for automobile refrigeration systems embedded with an internal oil separator in accordance with the third embodiment of the present invention.
Figure 11:
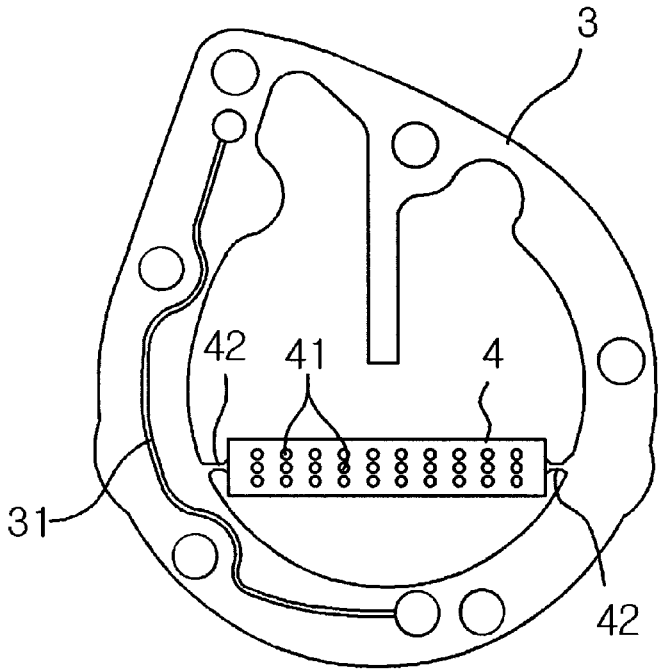
FIG. 11 is a view, showing an assemblage of a gasket with an oil-separating plate of the oil separator of FIG. 10.

FIGS. 10 and 11 are views, showing an internal oil separator for compressors in accordance with the third embodiment of the present invention.

As shown in the drawings, the general shape of the oil separator according to the third embodiment remains the same as that described for the second embodiment, but the oil-separating plate 4 is integrated with the gasket 3 into a single structure. In the following description for the third embodiment, it is thus not deemed necessary to further explain the construction or the operational effect of the same elements as those of the second embodiment.

In the internal oil separator according to the third embodiment, the oil-separating plate 4 has the same construction as that of the plate 4 according to the second embodiment, but is integrated with the gasket 3 at its opposite ends into a single structure. In order to produce the gasket 3 integrated with the oil-separating plate 4, it is preferred to primarily form a gasket 3, with an oil-separating plate 4 being integrated with the gasket 3 at its opposite ends into a single structure using opposite connection ribs 42 while being arranged on the same plane as that of the gasket 3. Thereafter, the plate 4 is rotated relative to the gasket 3 until the plane of the plate 4 crosses the gasket 3 at right angles. In the internal oil separator according to the third embodiment, it is possible to reduce the production cost of the oil-separating plate 4 since the plate 4 is integrated with the gasket 3 into a single structure different from the plate 4 according to the second embodiment.

Figure 12:
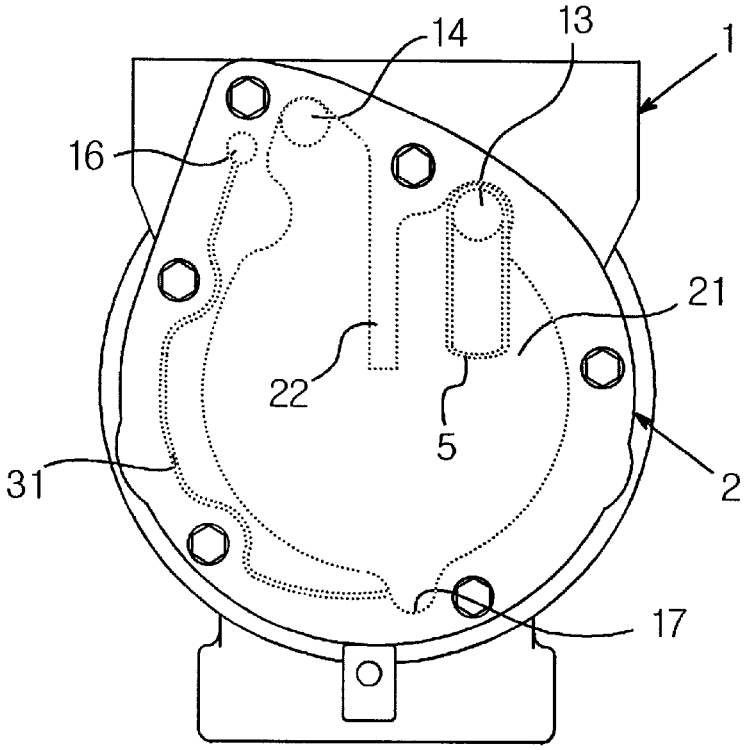
FIG. 12 is a partially opened-up rear view of a compressor for automobile refrigeration systems embedded with an internal oil separator in accordance with the fourth embodiment of the present invention.
Figure 13:
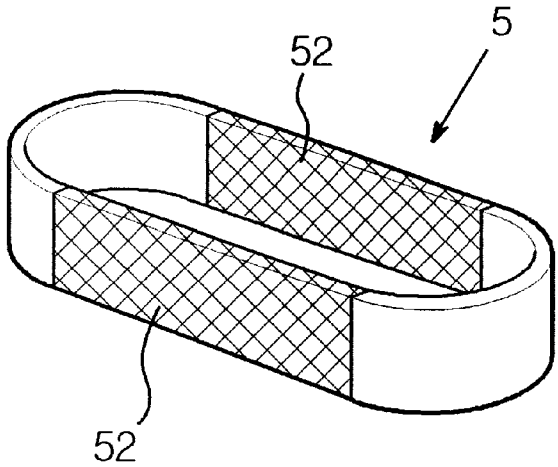
FIG. 13 is a perspective view of a screen member formed by single loop structure included in the oil separator of FIG. 12.

FIGS. 12 and 13 are views, showing an internal oil separator for compressors in accordance with the fourth embodiment of the present invention.

As shown in the drawings, the general shape of the oil separator according to the fourth embodiment remains the same as that described for the primary embodiment, but a screen member 5 formed by single loop structure is installed within an area around the inlet port 13 of the oil-separating chamber 21. In the following description for the fourth embodiment, it is thus not deemed necessary to further explain the construction or the operational effect of the same elements as those of the primary embodiment.

In the internal oil separator according to the fourth embodiment, the screen member 5 formed by single loop structure is a loop-type member fabricated by integrating two filtering nets, or forward and rear nets 52, into a loop using two webs. This loop-type screen member 5 is positioned within the oil-separating chamber 21 in a way such that the forward and rear nets 52 are respectively directed to the rear wall of the compressor housing 1 and the inside surface of the oil-separator cover 2. That is, the above screen member 5 is vertically positioned within the oil-separating chamber 21 so as to allow both the upper web and the upper end portions of the two nets 52 to surround the inlet port 13 of the housing 1.

When compressed and oil-laden gas refrigerant is introduced into the oil-separating chamber 21 through the inlet port 13, the gas refrigerant primarily comes into collision against both nets 52 of the screen member 5, thus being spattered on the nets 52. Due to the spattering of the oil-laden gas refrigerant on the screen member 5, the oil separating efficiency of this oil separator is further improved. This finally improves the durability of the compressor. In addition, a variety of foreign particular substances, such as metal chips undesirably mixed with the refrigerant during a circulation within a refrigeration system, are filtered by the opposite nets 52 of the screen member 5 and are dropped down onto the lower web of the screen member 5 so as to be deposited on the lower web. That is, the lower web of the screen member 5 defines a foreign substance storing chamber in cooperation with both the rear wall of the compressor housing 1 and the inside surface of the cover 2. The screen member 5 thus allows clean gas refrigerant free from such foreign substances to be discharged from the compressor into the condenser, and almost completely prevents the refrigerant line of a refrigeration system from being blocked by such foreign substances. This finally improves the fluidity of the refrigerant within the refrigeration system in addition to an improvement in heat exchanging efficiency of the system. Since such clean refrigerant free from foreign substances returns to the driving part chamber 18 of the compressor, the lubrication oil line within the compressor is free from being blocked by such foreign substances or the drive parts within the compressor is free from such foreign substances. The screen member 5 thus finally protects the compressor from damage.

The above screen member 5 acts in place of an expensive oil filter within the compressor, and so it is possible to reduce the production cost of compressors.

Figure 14:
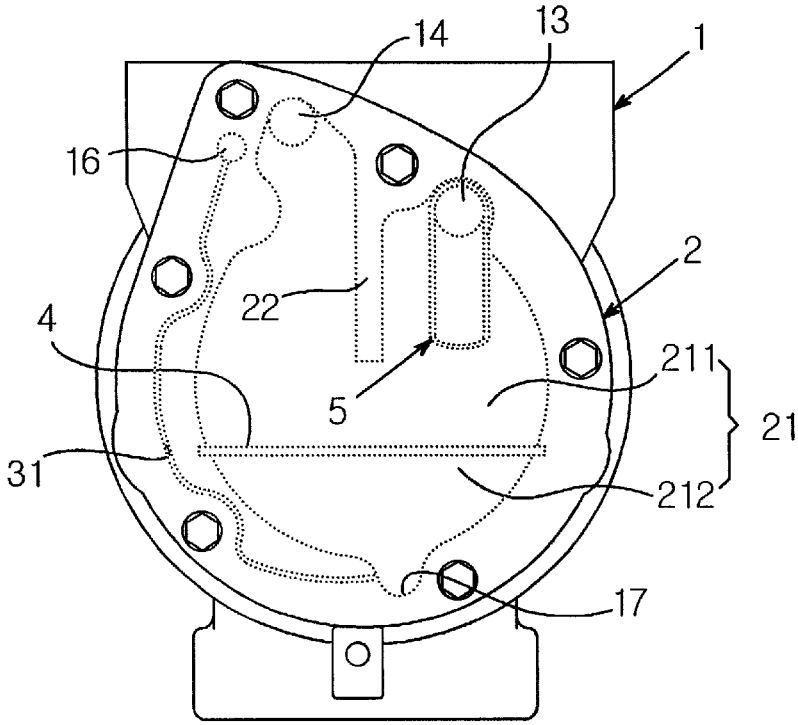
FIG. 14 is a partially opened-up rear view of a compressor for automobile refrigeration systems embedded with an internal oil separator in accordance with the fifth embodiment of the present invention.

FIG. 14 is a view, showing an internal oil separator for compressors in accordance with the fifth embodiment of the present invention.

As shown in the drawing, the general shape of the oil separator according to the fifth embodiment remains the same as that described for the second or third embodiment, but a screen member 5 formed by single loop structure, having the same construction as that of the fourth embodiment, is installed within an area around the inlet port 13 of the oil-separating chamber 21. Therefore, it is thus not deemed necessary to further explain the construction and operational effect of this oil separator.

Figure 15:
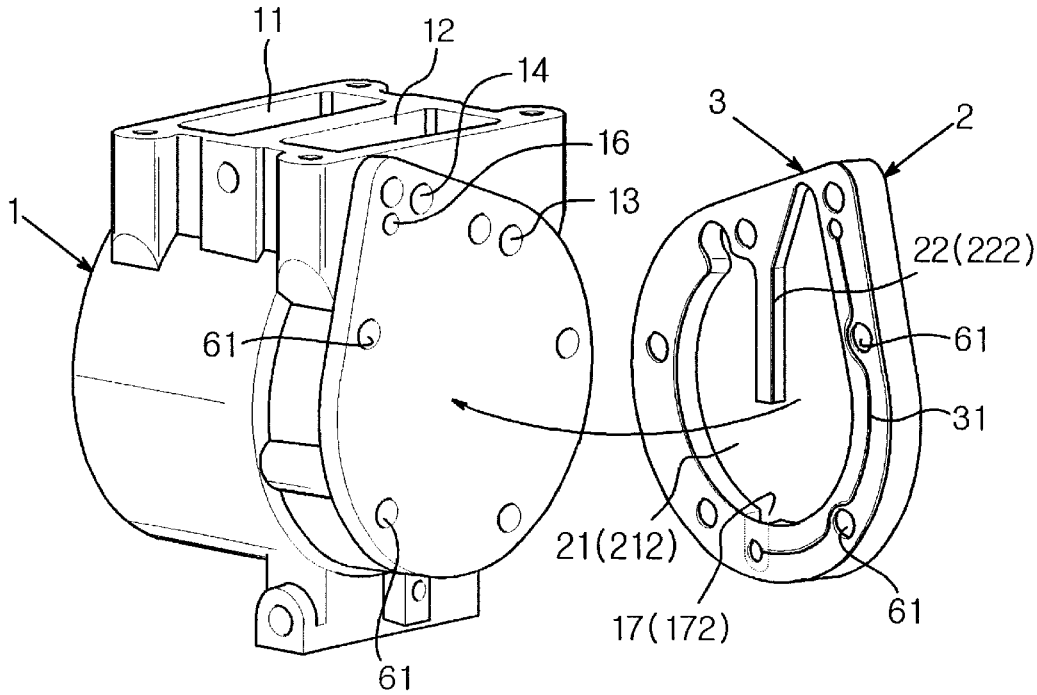
FIG. 15 is an exploded perspective view of a compressor for automobile refrigeration systems embedded with an internal oil separator in accordance with the sixth embodiment of the present invention.
Figure 16:
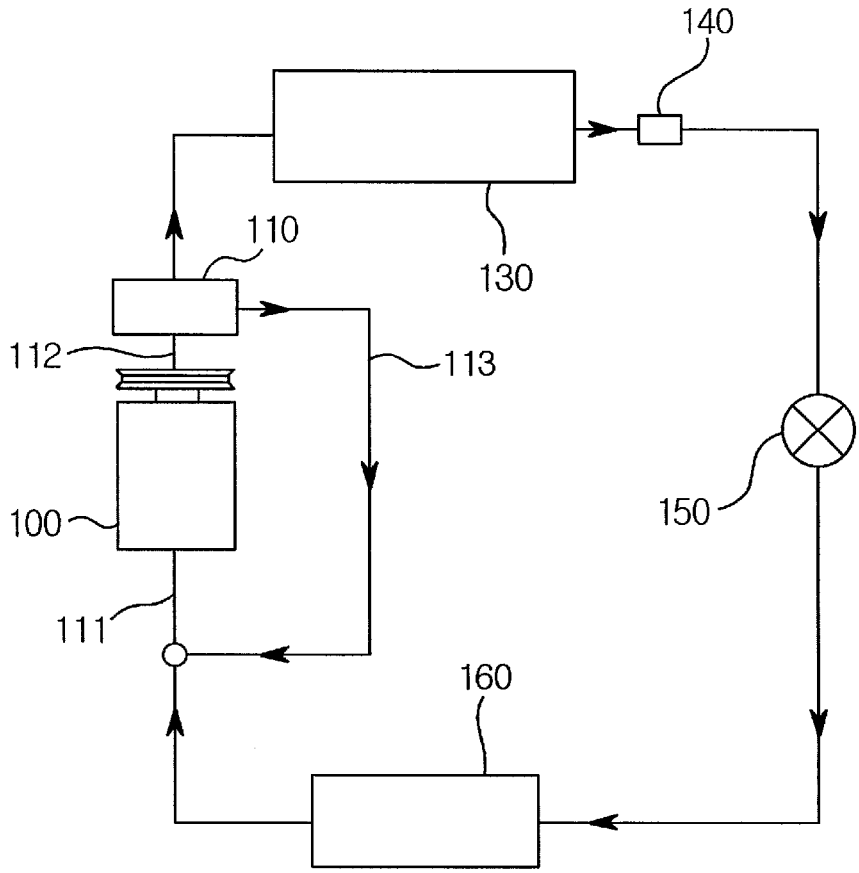
FIG. 16 is a circuit diagram of a refrigeration system provided with a conventional external oil separator.
Figure 17:
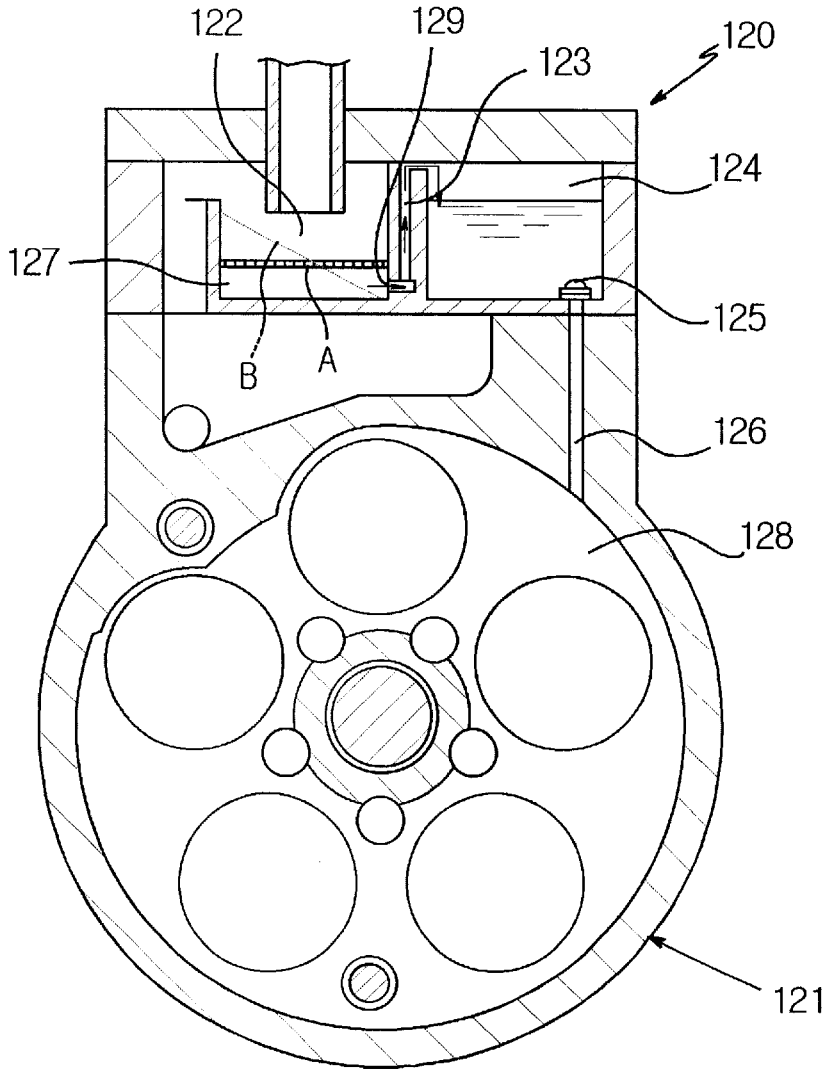
FIG. 17 is a sectional view of a compressor embedded with a conventional internal oil separator.

FIG. 15 is a view, showing an internal oil separator for compressors in accordance with the sixth embodiment of the present invention.

As shown in the drawing, the general shape of the oil separator according to the sixth embodiment remains the same as that described for the primary embodiment, but the oil-separating chamber 21 is formed by the second depression 212 and the second guide wall 222 of the cover 2 exclusively, with the compressor housing 1 being free from the first depression 211, and the oil-collecting part 17 is formed by the second oil-collecting groove 172 of the cover 2 exclusively, with the compressor housing 1 being free from the first oil-collecting groove 171. In the following description for the sixth embodiment, it is thus not deemed necessary to further explain the construction and operational effect of the same elements as those of the primary embodiment.

Such a simple and preferable construction with the oil-separating chamber 21 being defined by the second depression 212 of the cover 2 is allowed by the fact that the oil separator of this invention accomplishes an improved oil separating efficiency and it is not necessary to store a large quantity of recovered oil within the oil-separating chamber 21. When the oil-separating chamber 21 is formed by the second depression 212 of the cover 2 as described above, it is possible to make a thinner plate-type oil separator and to more effectively accomplish the recent trend of compactness of compressors.

As described above, the present invention provides an internal oil separator for compressors of automobile refrigeration systems. In this oil separator, the bottom of an oil-separating chamber 21 is depressed to form an oil-collecting part 17. Therefore, even when the chamber 21 is filled with a small quantity of recovered oil in the case of an unexpected inclined position of the compressor or a running of an automobile on bumpy road, it is possible to always supply an effective amount of oil to the drive parts of a compressor if the oil surface within the oil-separating chamber 21 is not reduced lower than the top end of the oil-collecting part 17. This finally protects the compressor from being damaged and prevents the drive parts of the compressor from being unexpectedly locked, and improves the durability of the compressor.

In the oil separator, the oil-separating chamber 21 is formed within the rear section of the compressor housing 1, with the oil-collecting part 17 being formed on the bottom of the chamber 21 by partially depressing said bottom. It is thus possible to always supply an effective quantity of lubrication oil to the drive parts of the compressor even when a small quantity of oil is filled in the oil-separating chamber 21. This finally reduces the amount of oil in charge in the compressor and also allows a thin plate-type oil separator to be effectively used as the internal oil separator, thus reducing the size of the oil separator in addition to the size of the compressor housing 1. Therefore, it is possible to accomplish the recent trend of compactness of compressors and to easily install the compressor within the engine compartment of an automobile. This allows a desired designing flexibility of such engine compartments.

In the oil separator of this invention, the refrigerant flowing passage within the oil-separating chamber 21 is accomplished by a U-shaped passage, thereby allowing compressed and oil-laden gas refrigerant to be spattered and affected by a centrifugal force while flowing through the U-shaped passage. Lubrication oil is thus effectively separated and recovered from the compressed and oil-laden gas refrigerant flowing within the oil-separating chamber 21. In this oil-separator, the recovered oil is free from being trailed by the dynamic force of the oil-laden gas refrigerant flowing along the U-shaped passage within the chamber 21 or from being remixed with the refrigerant, and so the oil separating efficiency of the oil separator is remarkably improved. In addition, when an oil-separating plate 4 and/or a screen member 5 formed by single loop structure are installed within the oil-separating chamber 21, it is possible to further improve the oil separating efficiency of the oil separator. Since the oil separator of this invention almost completely prevents such lubrication oil from circulating through the parts of a refrigeration system, such as a condenser, an expansion valve and an evaporator, it improves the fluidity of refrigerant within the refrigeration system in addition to the heat exchanging efficiency of the system. This finally improves the refrigeration efficiency of the system and preferably reduces the consumption of electric power of the system. It is also possible to increase the quantity of lubrication oil returning into the driving part chamber 18 of the compressor, and so the durability of the compressor is further improved.

During an oil recovering operation of the oil separator, oil-laden gas refrigerant flows along the U-shaped passage within the oil-separating chamber 21, thereby being primarily reduced in its flowing velocity. The oil-separating chamber 21 thus primarily reduces the operational noises, such as gas pulsation noises, of the compressor. The operational noises, such as gas pulsation noises, of the compressor are secondarily reduced when the gas refrigerant free from oil is discharged from the oil-separating chamber 21 into the refrigerant discharge port 12 of the housing 1 through the refrigerant outlet port 14. This finally allows the operational noises of the compressor to be free from irritating passengers of an automobile.

In the internal oil separator of this invention, a gasket 3, having an opening corresponding to the oil-separating chamber 21, is closely interposed between the rear wall of the compressor housing 1 and the oil separator cover 2. The above gasket 3 has first to third linear bead parts 311, 312 and 313 projected toward the cover 2. When the cover 2 is mounted to the compressor housing 1, the first to third bead parts 311, 312 and 313 are brought into close contact with the inside surface of the cover 2. The gasket 3 thus accomplishes a desired sealing effect capable of preventing oil-laden gas refrigerant, flowing in the oil-separating chamber 21, or recovered lubrication oil, stored in the oil-collecting part 17, or recovered lubrication oil, flowing from the oil-collecting part 17 into the oil return line 16 of the housing 1 through the oil return channel 31 of the gasket 3, from leaking from the compressor. The above gasket 3 also prevents a bypass flow of compressed gas refrigerant into the driving part chamber 18 of the compressor since the recovered oil, flowing from the oil-collecting part 17 into the oil return line 16 through the oil return channel 31, is not allowed to be remixed with the oil-laden gas refrigerant, flowing within the oil-separating chamber 21, due to the gasket 3.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An internal oil separator for compressors of refrigeration systems, comprising:

an oil-separating chamber having a generally U-shaped refrigerant flowing passage and being formed in a rear section of a compressor housing while being closed by an oil separator cover mounted to a rear wall of said compressor housing, with refrigerant suction and discharge ports being formed abreast on a top end of said compressor housing, said suction port being used for introducing gas refrigerant from an evaporator into a compressor and said discharge port being used for discharging compressed gas refrigerant from the compressor into a condenser;

a refrigerant inlet port formed on the rear wall of said compressor housing and used for introducing compressed and oil-laden gas refrigerant into said oil-separating chamber;

a refrigerant outlet port formed on the rear wall of said compressor housing and used for discharging compressed gas refrigerant, separated from oil, from said oil-separating chamber into said refrigerant discharge port;

an oil-collecting part formed on a bottom of said oil-separating chamber by partially depressing the bottom of said oil-separating chamber, said oil-collecting part being used for storing oil separated and recovered from the oil-laden refrigerant flowing within the oil-separating chamber;

an oil return line extending from an upper portion of said rear wall of the compressor housing and used for returning the recovered oil from the oil-collecting part into the refrigerant suction port; and a gasket tightly interposed between the compressor housing and the oil separator cover so as to seal a junction between the housing and the cover, with an oil return passage being formed on said gasket by cutting the gasket at a predetermined position, said oil return passage connecting the oil-collecting part to the oil return line.

2. The internal oil separator according to claim 1, wherein said oil-separating chamber is formed by both a first depression, having a closed curve profile similar to a circular or elliptical profile and being formed on the rear wall of said compressor housing, and a second depression, having the same profile as that of the first depression and being formed on an inside surface of said oil separator cover, with a guide wall part consisting of both a first guide wall, downwardly extending from a center of an upper portion of said first depression toward the oil-collecting part to a length, and a second guide wall formed on said second depression so as to correspond to the first guide wall, said guide wall part allowing said oil-separating chamber to have the generally U-shaped refrigerant flowing passage; and said oil-collecting part is formed by both a first oil-collecting groove, formed on a bottom of said first depression, and a second oil-collecting groove formed on a bottom of said second depression at a position corresponding to the first oil-collecting groove.

3. The internal oil separator according to claim 1, wherein said oil-separating chamber is formed by a depression, having a closed curve profile similar to a circular or elliptical profile and being formed only on an inside surface of said oil separator cover, with a guide wall downwardly extending from a center of an upper portion of said depression toward the oil-collecting part to a length while being projected toward the compressor housing, thus allowing said oil-separating chamber to have the generally U-shaped refrigerant flowing passage, and said oil-collecting part is formed by an oil-collecting groove formed on a bottom of said depression.

4. The internal oil separator according to claim 1, wherein an oil-separating plate, having a plurality of holes, is horizontally set within said oil-separating chamber at a position above the oil-collecting part, thus dividing the oil-separating chamber into an upper section, or an oil-separating section, and a lower section, or an oil-storing section.

5. The internal oil separator according to claim 4, wherein said oil-separating plate is integrated with said gasket at its opposite ends into a single structure.

6. The internal oil separator according to claim 4, wherein a screen member, formed by integrating a plurality of filtering nets together into a single loop structure, is positioned within the oil-separating chamber while surrounding the refrigerant inlet port of the compressor housing, thus allowing the compressed and oil-laden gas refrigerant to pass through the filtering nets when the refrigerant is introduced into the oil-separating chamber through the refrigerant inlet port.

7. The internal oil separator according to claim 5, wherein a screen member, formed by integrating a plurality of filtering nets together into a single loop structure, is positioned within the oil-separating chamber while surrounding the refrigerant inlet port of the compressor housing, thus allowing the compressed and oil-laden gas refrigerant to pass through the filtering nets when the refrigerant is introduced into the oil-separating chamber through the refrigerant inlet port.

8. The internal oil separator according to claim 1, wherein said gasket has a first bead part formed along opposite edges of said oil return channel, a second bead part extending from the first bead part while being formed along and edge of the oil-separating chamber so as to form a closed curve on the gasket in cooperation with the first bead part, and a third bead part formed around each locking bolt hole of the gasket.

* * * * *